US010240291B2

(12) United States Patent
Etschmaier

(10) Patent No.: US 10,240,291 B2
(45) Date of Patent: Mar. 26, 2019

(54) ROLLER WITH COATING

(71) Applicant: VOITH PATENT GMBH, Heidenheim (DE)

(72) Inventor: Alexander Etschmaier, Neuberg (AT)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 15/328,151

(22) PCT Filed: Jul. 2, 2015

(86) PCT No.: PCT/EP2015/065099
§ 371 (c)(1),
(2) Date: Jan. 23, 2017

(87) PCT Pub. No.: WO2016/012214
PCT Pub. Date: Jan. 28, 2016

(65) Prior Publication Data
US 2017/0211233 A1 Jul. 27, 2017

(30) Foreign Application Priority Data
Jul. 23, 2014 (DE) ..... 10 2014 214 395

(51) Int. Cl.
*C22C 9/00* (2006.01)
*C23C 4/06* (2016.01)
(Continued)

(52) U.S. Cl.
CPC ..... *D21F 5/021* (2013.01); *C22C 9/00* (2013.01); *C22C 38/26* (2013.01); *C23C 4/06* (2013.01);
(Continued)

(58) Field of Classification Search
CPC ..... C23C 4/06; D21F 5/02; D21G 1/02
(Continued)

(56) References Cited

U.S. PATENT DOCUMENTS 4,064,608 A 12/1977 Jaeger
4,160,048 A * 7/1979 Jaeger ..... B05B 13/0442 427/142
(Continued)

FOREIGN PATENT DOCUMENTS

CN 102039384 A 5/2011
DE 2744190 A1 6/1978
(Continued)

OTHER PUBLICATIONS

ASTM G65—04(2010) "Standard Test Method for Measuring Abrasion Using the Dry Sand/Rubber Wheel Apparatus", http://www.astm.org/Standards/G65.htm.

*Primary Examiner* — Jason L Vaughan
(74) *Attorney, Agent, or Firm* — Laurence A. Greenberg; Werner H. Stemer; Ralph E. Locher

(57) ABSTRACT

A heatable roller suitable for a machine for producing and/or upgrading a web of material, in particular a fibrous material web such as a paper, paperboard or tissue web. The roller has a main element with a metallic and cylindrical roller wall which is heatable by suitable means and on the radially outer side of which there is, at least in sections, a coating. When the roller is used as intended, the coating provides a web contact side which can be brought into contact with the web of material. The coating includes, or is formed by, at least one metallic or metal-carbidic layer with a first layer component providing a matrix and a second layer component distributed in the matrix. The first layer component has a higher abrasion resistance than the second layer component and the second layer component has a greater thermal conductivity than the first layer component.

19 Claims, 2 Drawing Sheets

(51) Int. Cl.

| | |
|---|---|
| ***C23C 4/08*** | (2016.01) |
| ***C23C 4/10*** | (2016.01) |
| ***D21F 5/02*** | (2006.01) |
| ***D21G 1/02*** | (2006.01) |
| ***C22C 38/26*** | (2006.01) |
| ***C23C 4/129*** | (2016.01) |

(52) U.S. Cl.
CPC ..... *C23C 4/08* (2013.01); *C23C 4/10* (2013.01); *C23C 4/129* (2016.01); *D21G 1/0246* (2013.01)

(58) Field of Classification Search
USPC ..... 492/17, 18, 20, 28, 46, 48, 49, 53, 54
See application file for complete search history.

(56) References Cited

U.S. PATENT DOCUMENTS

| | | | | |
|---|---|---|---|---|
| 5,123,152 | A | 6/1992 | Tenkula et al. | |
| 5,632,861 | A | 5/1997 | Crouse | |
| 8,684,895 | B2 | 4/2014 | Severing et al. | |
| 2009/0032501 | A1* | 2/2009 | Swingley ..... | C22C 29/08 219/76.12 |

FOREIGN PATENT DOCUMENTS

| | | | |
|---|---|---|---|
| DE | 102007018476 | A1 | 10/2008 |
| EP | 0383466 | A1 | 8/1990 |
| EP | 0383466 | B1 | 4/1994 |
| EP | 2213790 | A1 | 8/2010 |
| WO | 9641918 | A1 | 12/1996 |

* cited by examiner

ROLLER WITH COATING

BACKGROUND OF THE INVENTION

Field of the Invention

The invention relates to a heatable roller having a coating providing a web contact side, which is suitable for a machine for producing and/or upgrading a web of material, in particular a fibrous material web such as a paper, paperboard or tissue web. The invention also relates to a process for coating such a roller.

Heated rollers, for example drying cylinders or calender rollers, generally come into direct contact with the fibrous material web to be dried and/or smoothed. Here, good heat transfer from the cylindrical roller wall of the heated roller to the fibrous material web has to be ensured. For this reason, the roller wall of such rollers is generally composed of a metallic material such as cast iron or steel. To increase the abrasion resistance, it has been proposed in the past that the radially outer side of the roller wall, i.e. the side which provides a web contact side, be provided with an abrasion-resistant coating. Such coatings, as are known, for example, from EP0383466, have a high proportion of nitrides or carbides and are therefore very abrasion-resistant but have the disadvantage of a low thermal conductivity.

SUMMARY OF THE INVENTION

It is an object of the present invention to propose a heated roller having a coating on the roller wall, in which the coating has a thermal conductivity which is improved compared to the prior art combined with a satisfactory abrasion resistance.

The object is achieved by a heatable roller which is suitable for a machine for producing and/or upgrading a web of material, in particular a fibrous material web such as a paper, paperboard or tissue web, and comprises a main element having a metallic and cylindrical roller wall which is heatable by suitable means and on the radially outer cylindrical surface of which there is, at least in sections, a coating which, when the roller is used as intended, provides a web contact side which can be brought into contact with the web of material. The heatable roller of the invention is characterized in that the coating comprises or is formed by at least one metallic or metal-carbidic layer, where the at least one metallic or metal-carbidic layer comprises or is formed by a first layer component providing a matrix and a second layer component distributed in the matrix and the first layer component has a higher abrasion resistance than the second layer component and the second layer component has a greater thermal conductivity than the first layer component.

Suitable means of heating the roller wall are generally known and include means in the case of which the roller is heated using steam and/or oil and/or hot water and/or by means of radiation and/or induction.

The coating provides at least one layer having a first layer component and a second layer component, where the first layer component forms the matrix in which the second layer component is distributed, i.e. the two layer components are present separately from one another in the at least one layer and, in particular, do not form an alloy with one another. However, separate does not necessarily mean that these two layer components actually have to form two layers which are separate from one another, i.e. arranged above one another. Rather, it is intended for the purposes of the present invention that the two layer components each form one phase, so that the coating has (precisely) two different phases. The phases can therefore be dissolved in one another, penetrate into one another or surround one another. The provision of a layer having two separate layer components of which the first layer component has a higher abrasion resistance than the second layer component and the second layer component has a higher thermal conductivity than the first layer component provides an optimal layer component for each of the two functions, namely high thermal conductivity and high abrasion resistance, without compromises having to be made, as is the case, for example, for layers having only one layer component which has to meet both requirements simultaneously.

A metallic layer is for the present purposes a layer which has substantially metallic constituents or only metallic constituents. Furthermore, a metal-carbidic layer is a layer which has substantially metallic and carbidic constituents or only metallic and carbidic constituents.

Unless indicated otherwise, the statement that a layer or the coating has substantially a particular constituent means that this constituent is present in an amount of more than 50% by weight in the layer or coating.

Advantageous embodiments and further developments of the invention are indicated in the dependent claims.

The coating is preferably a metallic or metal-carbidic coating, i.e. all layers of the coating contain substantially or only metallic constituents or substantially or only a metallic and carbidic constituents.

There are various conceivable ways in which the second layer component can be built up. Thus, it is, for example, conceivable that the second layer component is formed substantially, in particular completely, by a plurality of discrete regions. In the present context, substantially means at least 75% by weight, preferably at least 85% by weight. The discrete regions of the second layer component have, in particular, a size in the range from 5 to 50 μm. Adjoining regions form grain boundaries between one another.

The second layer component can also at least partly form a 3-dimensional network. The formation of a 3-dimensional network significantly increases heat conduction in the at least one layer.

If the second layer component is composed at least partly of discrete regions, it is possible for a plurality, in particular a majority, of these discrete regions to be in contact at their boundaries and form at least a major part of the 3-dimensional network or form the 3-dimensional network. If the second layer component is at least partly in one piece, i.e. without grain boundaries, this single-piece section can form at least a major part of the 3-dimensional network or form the 3-dimensional network. The expression major part of the 3-dimensional network is intended to mean more than 50%, in particular more than 70%, of the spatial extension of the 3-dimensional network.

It is conceivable that the first layer component comprises, in particular is formed by, an iron-based alloy and/or a cermet. Furthermore, the iron-based alloy can comprise not only iron but also chromium and/or niobium and/or tantalum and/or molybdenum and/or silicon and/or boron and/or tungsten as further constituent(s). For the purposes of the present invention, an iron-based alloy is an iron alloy which consists to an extent of more than 50% by weight of iron. The iron-based alloy is preferably a high-alloy iron-based alloy. A high-alloy iron-based alloy displays, in particular, a high abrasion resistance. For the present purposes, the iron-based alloy is considered to be "high-alloy" when the proportion by mass of one of its alloying elements is more than 5% by weight. In this context, it is, in particular, conceivable that the iron-based alloy contains 3-5% by weight of tantalum, 3-6% by weight of niobium, 19-22% by weight of chromium and iron as balance.

The second layer component comprises, in particular, copper or a copper-based alloy or is, in particular, formed thereby. For the purposes of the present invention, a copper-based alloy is a copper alloy which consists to an extent of more than 50% by weight of copper. The ductile behavior of copper enables the adhesion of the at least one layer, in particular the coating, to the cylindrical surface of the heated roller to be improved as a result of which the heat transfer between coating and roller wall is improved.

Furthermore, preference is given to the at least one layer being formed by 60% by weight or more, preferably more than 75%, of the first layer component and by not more than 40% by weight, preferably 5-25% by weight, particularly preferably 10-15% by weight, of the second layer component. Such a division between the first and second layer components results in optimal setting of high abrasion resistance and high thermal conductivity of the at least one layer.

The coating is preferably formed by the at least one metallic or metal-carbidic layer; in particular, the coating is formed by a single one of the at least one metallic or metal-carbidic layers.

Furthermore, the at least one layer, in particular the coating, has a specific thermal conductivity of 15 W/mK or more, preferably in the range from 15 W/mK to 250 W/mK, particularly preferably in the range from 15 W/mK to 175 W/mK. The specific thermal conductivity can, for example, be measured by means of a laser flash apparatus marketed by NETSCH-Gerätebau GmbH in D95100 Selb, Germany, under the name "LFA 457 MicroFlash".

Furthermore, the at least one layer, preferably the layer providing the web contact side, has an abrasion resistance of less than 0.5 g, preferably less than 0.2 g, measured in accordance with ASTM G65-04.

Specifically, the roller can be a drying cylinder, in particular a drying cylinder for a single-row or two-row cylinder drying group or a Yankee drying cylinder. It is also conceivable for the heated roller to be a heated calender roller.

Experiments carried out by the applicant have shown that satisfactory stability of the coating combined with good heat transfer is ensured when the coating has a thickness in the range from 50 μm to 1500 μm, preferably from 100 μm to 1000 μm, particularly preferably not more than 800 μm. Specifically, the thickness of the coating in the case of a Yankee drying cylinder can be not more than 800 μm, in the case of a heated calender roller in the range 150-200 μm and in the case of a drying cylinder for a single-row or two-row cylinder drying group in the range from 200 to 350 μm.

According to a second aspect of the invention, a process for coating a heatable roller which has a main element with a metallic and cylindrical roller wall and is heatable by suitable means is proposed, wherein the process comprises the following steps:

a. provision of the radially outer side of the roller wall and
b. application of a coating which comprises or is formed by at least one metallic or metal-carbidic layer, where the at least one metallic or metal-carbidic layer is applied in such a way that it comprises or is formed by a first layer component providing a matrix and a second layer component distributed in the matrix and the first layer component has a higher abrasion resistance than the second layer component and the second layer component has a greater thermal conductivity than the first layer component.

The process of the invention can be used, in particular, for recoating of drying cylinders, which owing to the normal wear of the web contact side of such drying cylinders is necessary at regular intervals. However, it is in principle also applicable to other components, in particular components which are subject to severe abrasive wear, of the machine mentioned at the outset.

The process of the invention therefore preferably comprises the process step of surface-treating, in particular partly or fully grinding, the radially outer side of the roller wall and/or any existing coating before application of the coating. This measure enables grooves to be removed from the web contact side and the roundness of the heated roller, for example the drying cylinder, to be restored.

To produce the at least one layer, in particular the coating, it is possible to use a thermal spraying process, in particular a high-velocity flame spraying process (also referred to as HVOF). In this case, a powder mixture which comprises the starting materials for the first and second layer components can, for example, be used as starting material for producing the at least one layer. Specifically, it is possible to use, for example, a powder mixture which comprises a high-alloy iron-based powder and a pure copper powder, or consists of these powders. As an alternative to thermal spraying, the at least one layer, in particular the coating, can be produced by the laser cladding process.

To increase the smoothness of the web contact side and thus reduce abrasion and to increase heat transfer between web material and heated roller, it is useful for the metallic or metal-carbidic layer providing the web contact side to be ground after thermal spraying.

Comparative experiments have shown that reduced wear of scraper blades which are in contact with the coating during operation of the roller in order to scrape the roller can surprisingly be achieved by means of the invention. The effect is particularly notable when copper is used as second layer component. Although the mechanism of the effect is not fully known, it is assumed that the second layer component which is bound in the manner of a phase in the layer component serving as matrix additionally acts as dry lubricant or solid lubricant. The scraper blade gradually wears down the matrix during operation, as a result of which the second layer component is exposed by the scraper blade due to abrasion of the coating and comes into contact with the surface of the scraper blade. The second layer component embedded in the matrix thus "lubricates" the gap bounded by the scraper blade and the radially outermost surface of the roller.

The second layer component particularly preferably comprises a soft metal which in particular acts as solid lubricant, for example copper, brass, gunmetal, aluminum or lead, a mixture of these or corresponding alloys or is made (completely) of one of these. Other materials suitable for the intended use, in particular nonmetallic materials such as graphite, are also conceivable. Here, it can be advantageous both for use in heated or heatable rollers and in unheated rollers for the soft metal to have a comparatively high thermal conductivity.

The present invention is therefore in principle also applicable in the case of unheated or unheatable rollers or generally in the case of components which are subjected to severe abrasive stress of a machine as mentioned at the outset for producing and/or upgrading a web of material. The same applies analogously to the process for producing a coating. This is particularly true when the second layer component is selected so that it acts as solid lubricant and provides emergency running properties. In such a case, the second layer component can particularly preferably be selected in such a way that it has a relatively high thermal conductivity so that in the case of emergency running it can additionally conduct away heating produced by abrasion from the surface of the coating.

The present invention also provides a coating according to the invention for a component of such a machine, for example an (unheated) roller or scraper blade, and also a process for producing such a coating. Furthermore, the present invention also relates to a machine as mentioned at the outset for producing and/or upgrading a web of material, which comprises at least one component having a coating, such as a roller, according to the invention.

BRIEF DESCRIPTION OF THE SEVERAL VIEWS OF THE DRAWING

The invention is illustrated below with the aid of a working example, see table 1 and FIG. 1 and also FIGS. 2 and 3.

DESCRIPTION OF THE INVENTION

The present working example is a coating which is formed by only one metallic layer and has been applied to the radially outer side of the cylindrical surface of a Yankee drying cylinder and has the following properties and the following composition:

TABLE 1

| | Invention | Competition sample 1 (competition HVOF) | Competition sample 2 (competition arc) |
|---|---|---|---|
| Composition: | Iron-based alloy: Fe > 70% by weight, Cr 20.6% by weight, Nb 4.5% by weight, Ta 3.5% by weight Pure copper (99.9% by weight of Cu) Ratio of iron-based alloy to copper in the layer: 85% by weight to 15% by weight | Fe balance, Mn 2% by weight, Cr 14% by weight, Mo 24% by weight, W 10% by weight, C 5% by weight | Fe balance, Mn 1.65% by weight, Cr 29% by weight, B 3.75% by weight, Si 1.6% by weight, |
| Thermal conductivity | 32 W/mK | 9 W/mK | 11 W/mK |
| Abrasion resistance ASTM G65-04 | 0.17 g | 0.2 | 0.2 |

It can be seen that the solution according to the invention provides a significantly higher thermal conductivity than is known from the prior art, at a comparable abrasion resistance.

Figure 1:
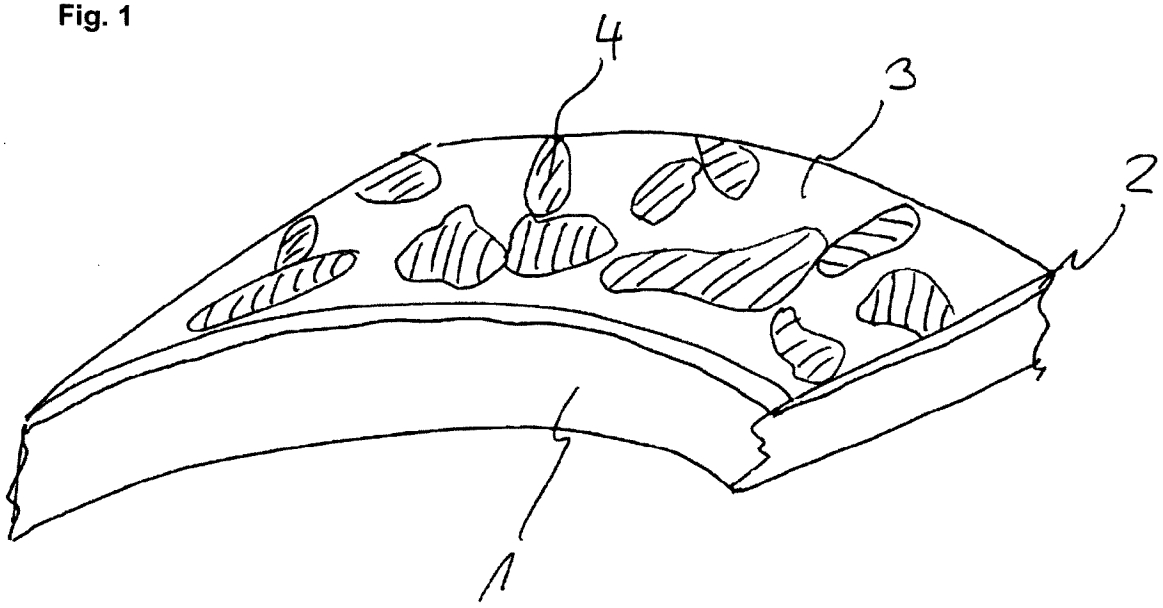
Figure 2:
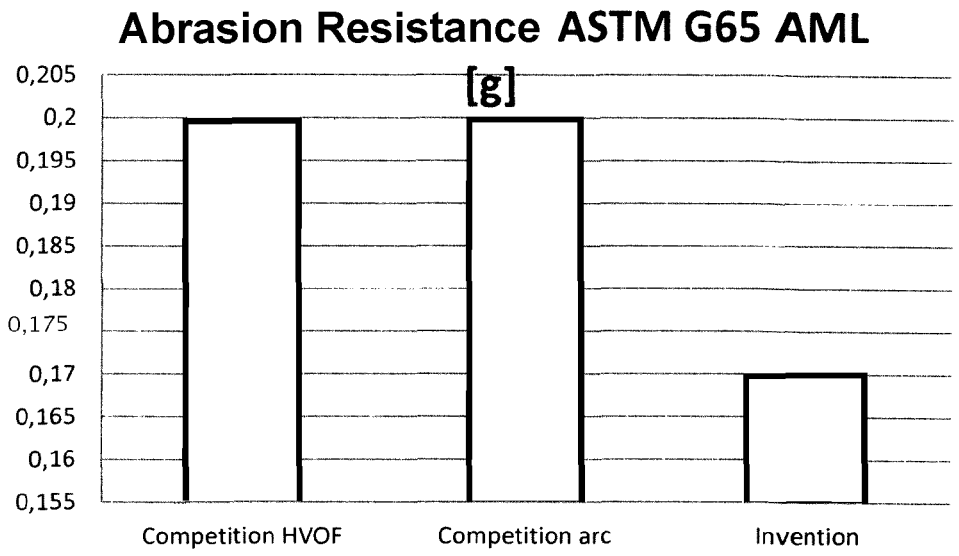
Figure 3:
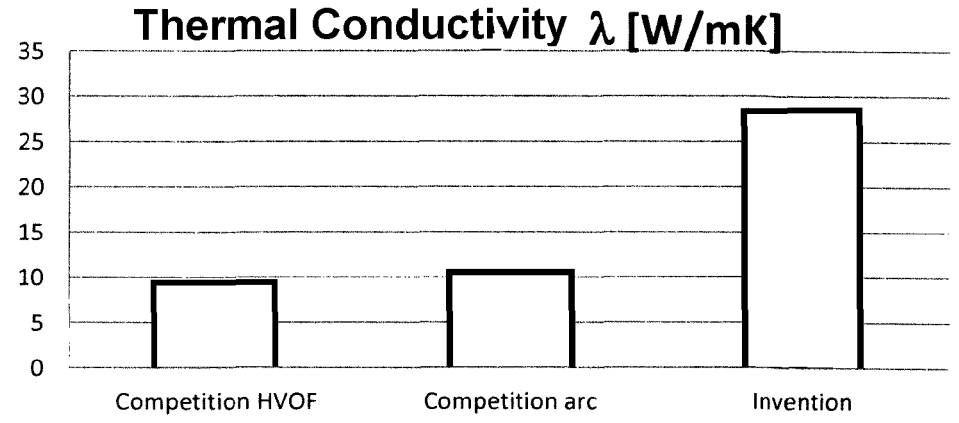

FIG. 1 shows a section, which is not to scale, of a roller wall 1 of a Yankee drying cylinder having the coating 2 according to the invention as per table 1. The coating 2 is formed by a metallic layer which in turn is formed by a first layer component 3 providing a matrix and a second layer component 4 (shown hatched) distributed in the matrix 3.

In the present case, the second layer component 4 is pure copper (99.9% by weight) and in its entirety formed by a plurality of discrete regions which at least partly adjoin one another. The discrete regions of the second layer component 4 have a size in the range from 5 to 50 μm. Furthermore, the second layer component 4 at least partly forms a 3-dimensional network, with a majority of the discrete regions of the second layer component 4 being in contact at the boundaries to form the 3-dimensional network.

The layer 2 and thus the coating has a specific thermal conductivity in the region of 32 W/mK and an abrasion resistance in the region of 0.2 g measured in accordance with ASTM G65-04. The thickness of the coating 2 is 500 μm.

The invention claimed is:

1. A heatable roller for a machine for processing a web of material, the roller comprising:

a main element having a heatable, metallic, cylindrical roller wall;

a coating formed on a radially outer side of said roller wall, at least in sections thereof, for providing a web contact surface to be brought into contact with the web of material;

said coating including at least one metallic or metal-carbidic layer, said at least one metallic or metal-carbidic layer including a first layer component providing a matrix and a second layer component distributed in said matrix;

said at least one layer being formed with 60% by weight or more of said first layer component and with not more than 40% by weight of said second layer component; and said first layer component having a higher abrasion resistance than said second layer component and said second layer component having a greater thermal conductivity than said first layer component.

2. The heatable roller according to claim 1, wherein said second layer component is formed, in essence, of a plurality of discrete regions.

3. The heatable roller according to claim 2, wherein discrete regions of said second layer component have a size in a range from 5 to 50 μm.

4. The heatable roller according to claim 1, wherein said first layer component comprises, of consists of, an iron-based alloy and/or a cermet.

5. The heatable roller according to claim 4, wherein said iron-based alloy comprises iron and at least one further constituent selected from the group consisting of chromium, niobium, tantalum, molybdenum, silicon, boron and tungsten.

6. The heatable roller according to claim 1, wherein said second layer component comprises, or consists of, copper or a copper-based alloy.

7. The heatable roller according to claim 1, wherein said second layer component is configured to at least partly form a 3-dimensional network.

8. The heatable roller according to claim 7, wherein a plurality of discrete regions of the second layer component are in contact with one another to form the 3-dimensional network.

9. The heatable roller according to claim 1, wherein said coating is formed by a single one of said at least one metallic or metal-carbidic layer.

10. The heatable roller according to claim 1, wherein said at least one layer has a specific thermal conductivity in a range from 15 W/mK to 250 W/mK.

11. The heatable roller according to claim 1, wherein said at least one layer has an abrasion resistance of less than 0.6 g measured in accordance with ASTM G65-04.

12. The heatable roller according to claim 1, wherein said coating has a thickness in a range from 50 μm to 1500 μm.

13. The heatable roller according to claim 1, wherein said coating consists of said at least one metallic or metal-carbidic layer.

14. The heatable roller according to claim 1, wherein said second layer component consists of copper or a copper-based alloy.

15. A heatable roller for a machine for processing a web of material, the roller comprising:

a main element having a heatable, metallic, cylindrical roller wall;

a coating formed on a radially outer side of said roller wall, at least in sections thereof, for providing a web contact surface to be brought into contact with the web of material;

said coating including at least one metallic or metal-carbidic layer, said at least one metallic or metal-carbidic layer including a first layer component providing a matrix and a second layer component distributed in said matrix;

said second layer component comprising copper or a copper-based alloy; and said first layer component having a higher abrasion resistance than said second layer component and said second layer component having a greater thermal conductivity than said first layer component.

16. A process for coating a heatable roller of a machine for processing a web of material, the process comprising:

providing a roller body with a heatable, metallic and cylindrical roller wall; and applying a coating to a radially outer side of the roller wall, the coating including at least one metallic or metal-carbidic layer, thereby applying the at least one metallic or metal-carbidic layer with a first layer component providing a matrix and a second layer component distributed in the matrix, the first layer component having a higher abrasion resistance than the second layer component and the second layer component having a greater thermal conductivity than the first layer component;

forming the coating with 60% by weight or more of the first layer component and with not more than 40% by weight of the second layer component.

17. The process for coating a heatable roller according to claim 16, which comprises surface-treating the radially outer side of the roller wall prior to applying the coating.

18. The process for coating a heatable roller according to claim 17, wherein the surface-treating step comprises grinding a radially outer surface of the roller wall.

19. The process for coating a heatable roller according to claim 16, which comprises producing the at least one layer by thermal spraying and grinding the metallic or metal-carbidic layer providing the web contact side after the thermal spraying.

* * * * *